US008827439B2

(12) United States Patent
Herrmann

(10) Patent No.: US 8,827,439 B2
(45) Date of Patent: Sep. 9, 2014

(54) SELF-CLEANING MEDIA PERFORATOR

(75) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 115 days.

(21) Appl. No.: 13/589,787

(22) Filed: Aug. 20, 2012

(65) Prior Publication Data

US 2014/0049588 A1 Feb. 20, 2014

(51) Int. Cl.
*B41J 2/01* (2006.01)
*B41J 11/66* (2006.01)

(52) U.S. Cl.
CPC ..... *B41J 11/66* (2013.01)
USPC ..... 347/104; 347/17; 347/102

(58) Field of Classification Search
CPC ..... B41J 3/24; B41J 11/66; B41J 11/68; B26F 1/0092; B26F 1/02–1/046
See application file for complete search history.

(56) References Cited

U.S. PATENT DOCUMENTS 4,561,335 A * 12/1985 Wingen ..... 83/481
4,667,552 A 5/1987 Calligarich
4,679,474 A 7/1987 Lambrecht
5,313,863 A * 5/1994 Aihara et al. ..... 83/171
5,349,890 A 9/1994 Butkus et al.
5,379,962 A 1/1995 Albrecht et al.
5,751,303 A 5/1998 Erickson et al.
5,810,279 A 9/1998 Rodriguez et al.
6,530,655 B2 3/2003 Jones et al.
6,565,700 B2 5/2003 Choate
6,652,172 B2 11/2003 Wood et al.
6,905,201 B2 6/2005 Leighton
7,625,146 B2 12/2009 Vogel
8,210,077 B2 7/2012 Carmichael et al.
2005/0074260 A1 4/2005 King et al.
2005/0206670 A1 * 9/2005 Kitamura et al. ..... 347/17
2006/0180273 A1 8/2006 Beck
2008/0106025 A1 5/2008 Padros et al.
2010/0002048 A1 * 1/2010 Masaoka ..... 347/36
2010/0086339 A1 * 4/2010 Levy et al. ..... 400/621

* cited by examiner

*Primary Examiner* — Shelby Fidler
*Assistant Examiner* — Tracey McMillion
(74) *Attorney, Agent, or Firm* — Maginot, Moore & Beck, LLP

(57) ABSTRACT

A media perforator for a printer disables ink from adhering to a perforation disk of the perforator. The media perforator includes a heater that applies radiant heat to a first side and a reverse side of rotating disk. The disk is heated to a predetermined temperature that prevents ink from adhering to the rotating disk as the rotating disk spins.

5 Claims, 6 Drawing Sheets

SELF-CLEANING MEDIA PERFORATOR

TECHNICAL FIELD

This disclosure relates generally to finishing apparatus for inkjet printers, and, in particular, to rollers that perforate media in a phase change inkjet printer.

BACKGROUND

In general, inkjet printing machines or printers include at least one printhead that ejects drops or jets of liquid ink onto an image receiving member, which may be media, either in sheet or web form, or a rotating intermediate member from which the ink is later transferred to media. A phase-change inkjet printer employs phase change inks that are solid at ambient temperature, but transition to a liquid phase at an elevated temperature. The melted ink can then be ejected by a printhead directly onto an image receiving substrate, or onto an intermediate imaging member for transfer to an image receiving substrate. Once the ejected ink is on the image receiving substrate, the ink droplets are transfixed by pressure and/or heat to form a durable ink image on the substrate.

In some phase change ink imaging devices, the image receiving substrates are individual sheets of recording media. The sheets are typically stored in one or more supply trays and retrieved, one at a time, for image processing. This type of printer is very effective for customized image renderings and document production. In other phase change ink imaging devices, the image receiving substrate is a web of recording media that is continuously fed into the printer on a path that transports the media past the printheads to receive ejected ink and then the media is transported to an output area. In some web printers, the web is rewound onto a take-up roll, while in others the web is cut into sheets or otherwise processed.

Some web printers are configured to cut perforations in printed media to enable binding of the printed media through the perforations or subsequent separation of the perforated portion. The perforations are typically formed by a perforation wheel or roller, which has a plurality of blades around the circumference of the wheel that cut small lines or holes in the media web as the web is fed through a nip formed between the perforation wheel and a backer roller. Phase change ink can sometimes transfer from printed media or other printer components and adhere to the surfaces of the perforation wheel and in areas on and between the teeth of the perforation wheel. Phase change ink on the perforation wheel can be deposited on subsequently printed media, reducing the quality of images produced on the media. Thus, removal of phase change ink from perforation wheels is a desirable goal.

SUMMARY

In one embodiment a media perforator is configured to disable ink from adhering to the media perforator. The perforator comprises a rotating disk and a heater. The rotating disk has a plurality of teeth positioned around a circumference of the rotating disk, the teeth being configured to form perforations in media as the media engages the rotating disk. The heater is configured to radiantly heat a portion of a first side of the rotating disk and a portion of a reverse side of the rotating disk to maintain the rotating disk at a predetermined temperature that disables ink from adhering to the rotating disk as the rotating disk spins.

In another embodiment a method of perforating media in a phase change ink printer disables ink from adhering to a media perforator. The method comprises feeding media into a nip formed between a rotating disk having a plurality of teeth around a circumference of the rotating disk and a roller to enable the teeth to perforate the media passing through the nip and radiantly heating a portion of a first side of the rotating disk and a portion of a reverse side of the rotating disk to maintain the rotating disk at a predetermined temperature that disables from adhering to the rotating disk.

In yet another embodiment, a printer has been developed that disables ink from adhering to a media perforator. The printer comprises a rotating disk, a roller, and a heater. The rotating disk has a plurality of teeth positioned around a circumference of the rotating disk, the teeth being configured to form perforations in a media web as the media web engages the rotating disk. The roller is configured to contact the teeth of the rotating disk to form a nip through which the media web is transported. The heater is configured to radiantly heat a portion of a first side of the rotating disk and a portion of a reverse side of the rotating disk to maintain the rotating disk at a predetermined temperature that disables ink from adhering to the rotating disk as the rotating disk spins.

DETAILED DESCRIPTION

Figure 1:
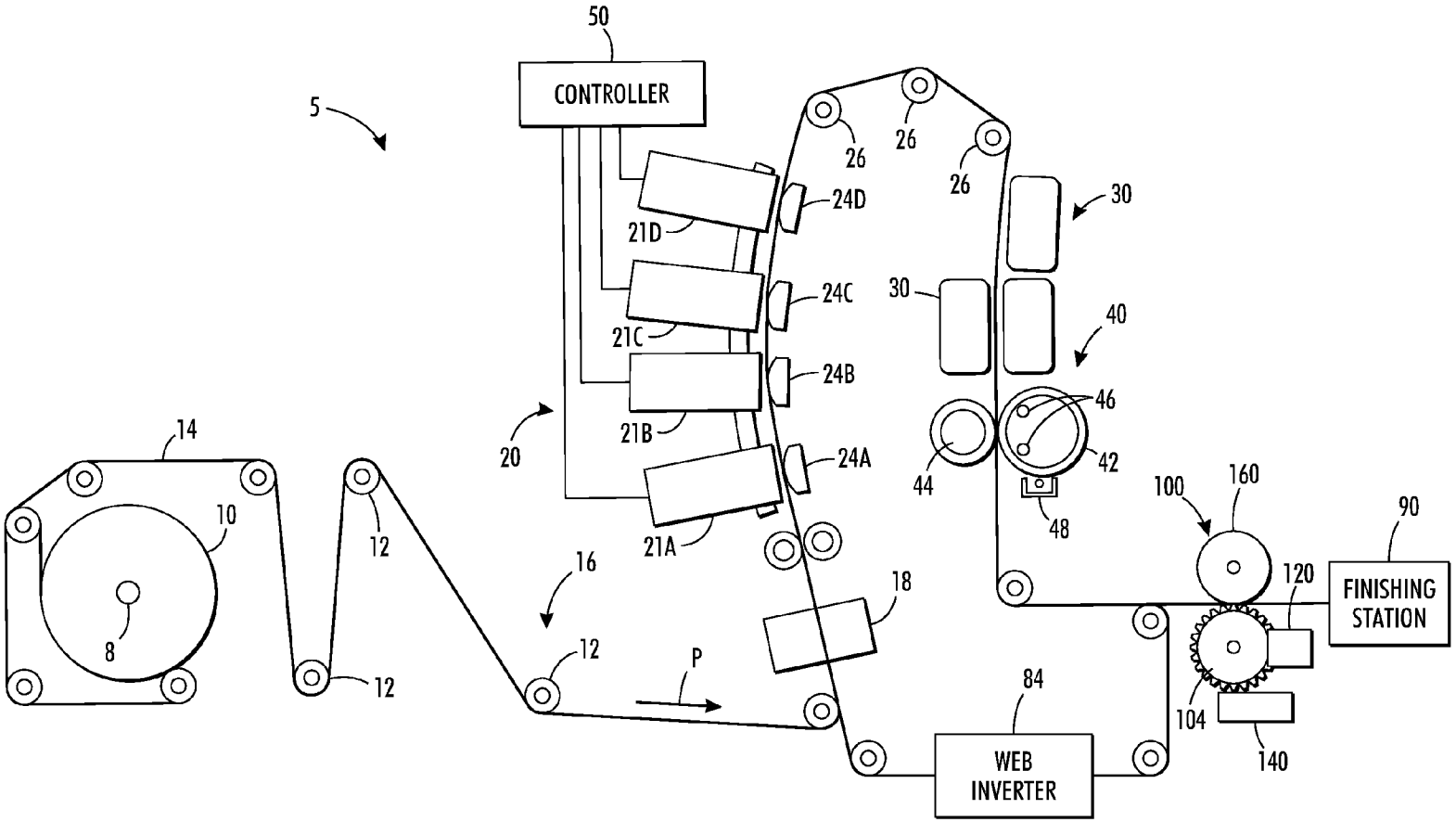
FIG. 1 is a schematic view of a continuous feed phase change inkjet printer having a media perforator.

For a general understanding of the present embodiments, reference is made to the drawings. In the drawings, like reference numerals have been used throughout to designate like elements. As used herein, the terms "printer," "printing device," or "imaging device" generally refer to a device that produces an image with one or more colorants on print media and may encompass any such apparatus, such as a digital copier, bookmaking machine, facsimile machine, multi-function machine, or the like, which generates printed images for any purpose. Image data generally include information in electronic form which are rendered and used to operate inkjet ejectors in a printer to form an ink image on the print media. These data may include text, graphics, pictures, and the like. The operation of producing images with colorants on print media, for example, graphics, text, photographs, and the like, is generally referred to herein as printing or marking. Phase change ink printers use phase change ink, also referred to as solid ink, which is solid at room temperature but melts into a liquid at a higher temperature. The liquid ink drops are printed onto an image receiving surface in either a direct or indirect printer.

In a direct printer, the printheads eject ink drops directly onto a print medium, for example, a media sheet or a continuous media web. After ink drops are printed on the print medium, the printer moves the print medium through a nip formed between two rollers that apply pressure and, optionally, heat to the ink drops and print medium. One roller, typically referred to as a "spreader roller," contacts the printed side of the print medium. The second roller, typically referred to as a "pressure roller," presses the media against the spreader roller to spread the ink drops and fix the ink to the print medium.

For illustrative purposes, the media perforator is described below with reference to a continuous-media direct-to-sheet phase change inkjet printer. The reader should appreciate, however, that the media perforator can be utilized in an indirect printer and/or a printer that prints on pre-cut media sheets, and that the media perforator can be used with other types of ink, for example, aqueous, emulsified, gel, or UV curable ink, or with electrophotographic printers. FIG. 1 is a simplified schematic view of the direct-to-sheet, continuous-media, phase-change inkjet printer 5 that is configured with a heated perforation disk. A media supply and handling system is configured to supply a long, substantially continuous web of media 14 of "substrate" (paper, plastic, or other printable material) from a media source, such as spool of media 10 mounted on a web roller 8. For simplex printing, the printer is comprised of feed roller 8, media conditioner 16, print zone or printing station 20, media perforator 100, and finishing station 90. For duplex operations, the web inverter 84 is used to flip the web over to present a second side of the media to the printing station 20 before being fed through the media perforator 100 and processed by the finishing station 90. In the simplex operation, the media source 10 has a width that substantially covers the width of the rollers 12 and 26 over which the media travels through the printer. In duplex operation, the media source is approximately one-half of the roller width as the web travels over one-half of the rollers in the printing station 20 and printed web conditioner 80 before being flipped by the inverter 84 and laterally displaced by a distance that enables the web to travel over the other half of the rollers opposite the printing station 20 for the printing, conditioning, and coating, if necessary, of the reverse side of the web. As described in detail below, the media perforator 100 is configured to pierce the media web to form one or more lines that enable the perforated section to be separated from the media web. The finishing station 90 is configured to cut, bind, collate, staple, and/or otherwise process the completed print job after the media perforator 100 has pierced the media web 14. In some embodiments, the media perforator is configured as part of the finishing station.

The media can be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media can be transported along the path in cut sheet form, in which case the media supply and handling system can include any suitable device or structure that enables the transport of cut media sheets along an expected path through the imaging device. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which, in one practical embodiment, is in a range of about 30° C. to about 70° C.

The media web is transported through a printing station 20 that includes a series of color units 21A, 21B, 21C, and 21D, each color unit effectively extending across the width of the media and being able to place ink directly (i.e., without use of an intermediate or offset member) onto the moving media. Each of the color units 21A-21D includes a plurality of printheads positioned in a staggered arrangement in the cross-process direction over the media web 14. As is generally familiar, each of the printheads can eject a single color of ink, one for each of the colors typically used in four color printing, namely, cyan, magenta, yellow, and black (CMYK). The controller 50 of the printer receives velocity data from encoders mounted proximately to rollers positioned on either side of the portion of the path opposite the four printheads to compute the position of the web as it moves past the printheads. The controller 50 uses these data to generate timing signals for actuating the inkjets in the printheads to enable the four colors to be ejected with a reliable degree of accuracy for registration of the differently colored patterns to form four primary-color images on the media. The inkjets actuated by the firing signals correspond to image data processed by the controller 50. The image data can be transmitted to the printer, generated by a scanner (not shown) that is a component of the printer, or otherwise electronically or optically generated and delivered to the printer. In various alternative embodiments, the printer 5 includes a different number of color units and can print inks having colors other than CMYK.

The printer 5 is configured to use "phase-change ink," by which is meant that the printer uses ink that is substantially solid at room temperature and becomes substantially liquid when heated to a phase change ink melting temperature for jetting onto the imaging receiving surface. The phase change ink melting temperature can be any temperature that is capable of melting solid phase change ink into liquid or molten form. In one embodiment, the phase change ink melting temperature is approximately 60° C.

Associated with each of color units 21A-21D is a corresponding backing member 24A-24D, respectively. The backing members 24A-24D are typically in the form of a bar or roller, which is arranged substantially opposite the printhead on the back side of the media. Each backing member is used to position the media at a predetermined distance from the printhead opposite the backing member. The backing members can be configured to emit thermal energy to heat the media to a predetermined temperature which, in one practical embodiment, is in a range of about 40° C. to about 60° C. The various backer members can be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media web 14 moves to receive inks of various colors from the printheads of the print zone 20, the printer 5 maintains the temperature of the media web within a predetermined range. The printheads in the color modules 21A-21D eject ink at a temperature typically significantly higher than the temperature of the media web 14. Consequently, the ink heats the media. Therefore, other temperature regulating devices can be employed to maintain the media temperature within a predetermined range. For example, the air temperature and air flow rate behind and in front of the media may also impact the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable feedback regulation of the media temperature.

Following the print zone 20 along the media path, the media web 14 moves over guide rollers 26 to one or more "mid-heaters" 30. A mid-heater 30 can use contact, radiant, conductive, and/or convective heat to control a temperature of the media. Depending on the temperature of ink and paper at rollers 26, this "mid-heater" can add or remove heat from the paper and/or ink. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. The mid-heater 30 adjusts substrate and ink temperatures to 0° C. to 20° C. above the temperature of the spreader.

Following the mid-heaters 30, a fixing assembly 40 is configured to apply heat and/or pressure to the media to fix the images to the media. The fixing assembly includes any suitable device or apparatus for fixing images to the media including heated or unheated pressure rollers, radiant heaters, heat lamps, and the like. In the embodiment of FIG. 1, the fixing assembly includes a "spreader" 40, that applies a predetermined pressure, and in some implementations, heat, to the media. The function of the spreader 40 is to take what are essentially droplets, strings of droplets, or lines of ink on the web 14 and smear the ink out by pressure and, in some systems, heat, so that spaces between adjacent drops are filled and image solids become uniform. In addition to spreading the ink, the spreader 40 also improves image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web 14 to a temperature in a range from about 35° C. to about 80° C. In alternative embodiments, the fixing assembly can be configured to spread the ink using non-contact heating (without pressure) of the media after the print zone. Such a non-contact fixing assembly uses any suitable type of heater to heat the media to a desired temperature, such as a radiant heater, UV heating lamps, and the like.

In one practical embodiment, the roller temperature in spreader 40 is maintained at a temperature of about 55° C., though the roller temperature can be different in other embodiments depending on the properties of the ink. Generally, a lower roller temperature gives less line spread while a higher temperature causes imperfections in the gloss. Roller temperatures that are too high may cause ink to offset to the roller. In one practical embodiment, the nip pressure is set in a range of about 500 to about 2000 psi lbs/side. Lower nip pressure gives less line spread while higher pressure may reduce pressure roller life.

The spreader 40 also includes a cleaning/oiling station 48 associated with image-side roller 42. The station 48 cleans and/or applies a layer of a release agent or other material to the roller surface. The release agent material can be an amino silicone oil having viscosity of about 10-200 centipoises. Only small amounts of oil are required and the oil carried by the media is only about 1-10 mg per A4 size page. In one possible embodiment, the mid-heater 30 and spreader 40 can be combined into a single unit with their respective functions occurring relative to the same portion of media simultaneously.

Following passage through the spreader 40 the printed media can be fed through the media perforator 100 and processed by the finishing station 90 for removal from the system (simplex printing) or directed to the web inverter 84 for inversion and displacement to another section of the rollers for a second pass by the printheads, mid-heaters, and spreader. The duplex printed material can then be fed through the perforator 100 and processed by the finishing station 90. Alternatively, the media can be directed to a rewind unit after being perforated, where the media is wound onto a roller for removal from the system and subsequent processing.

Operation and control of the various subsystems, components and functions of the printer 5 are performed with the aid of the controller 50. The controller 50 can be implemented with general or specialized programmable processors that execute programmed instructions. The instructions and data required to perform the programmed functions are stored in memory associated with the processors or controllers. The processors, their memories, and interface circuitry configure the controllers and/or print engine to perform the functions required for operation of the printer. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Figure 2:
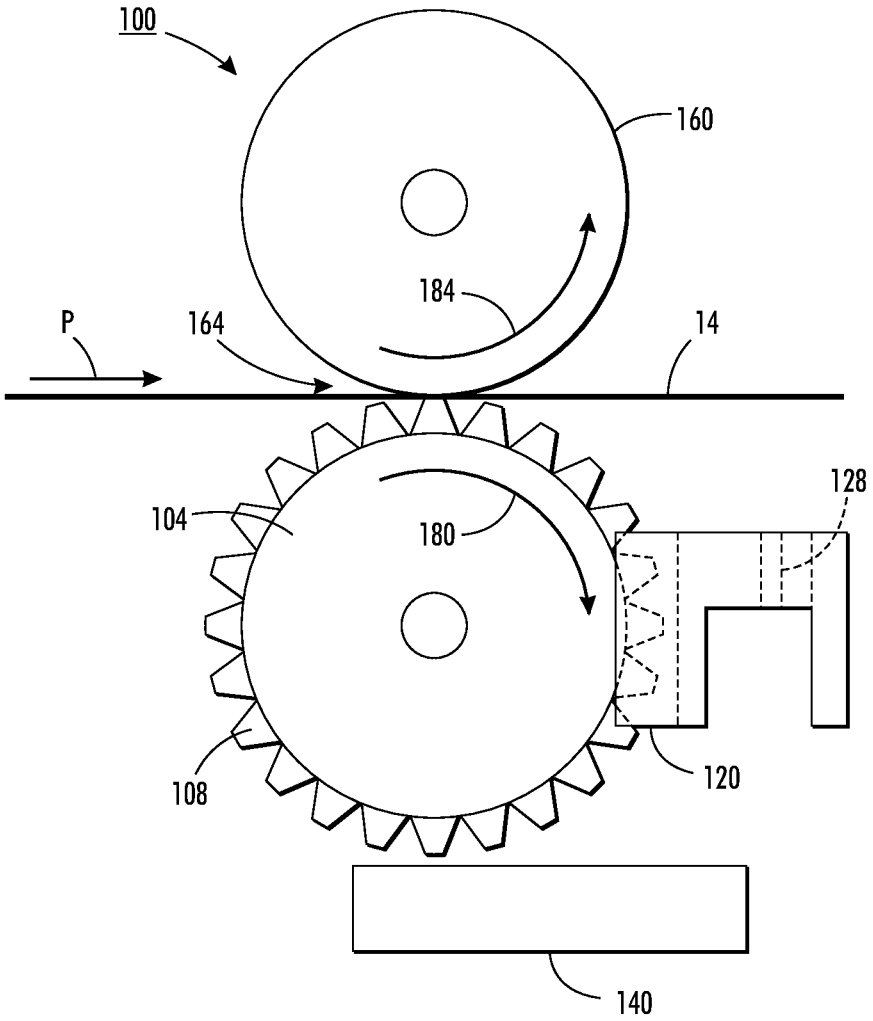
FIG. 2 is a side view of the media perforator of FIG. 1.
Figure 3:
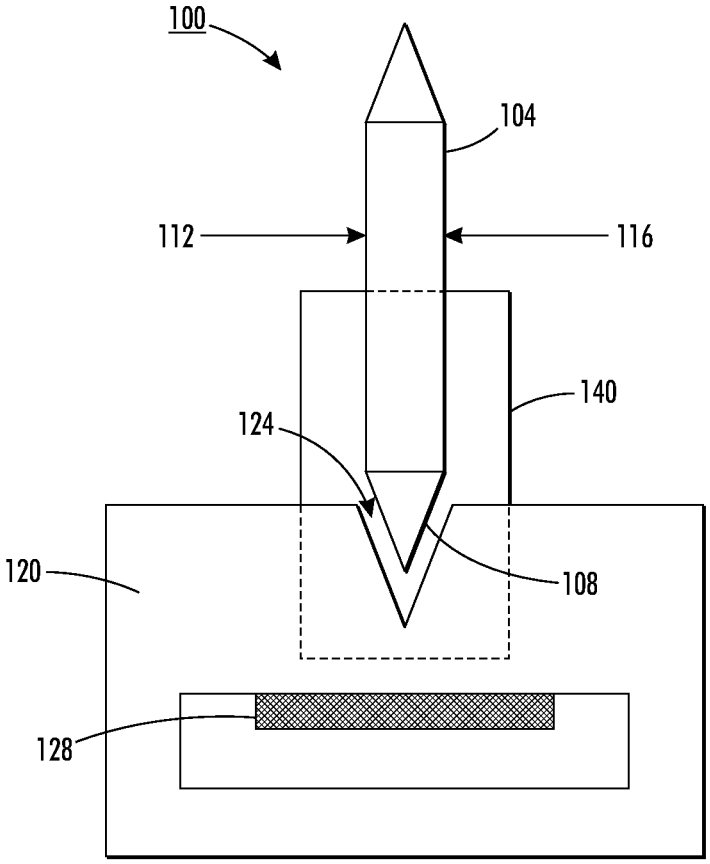
FIG. 3 is a top view of the media perforator of FIG. 1.
Figure 4:
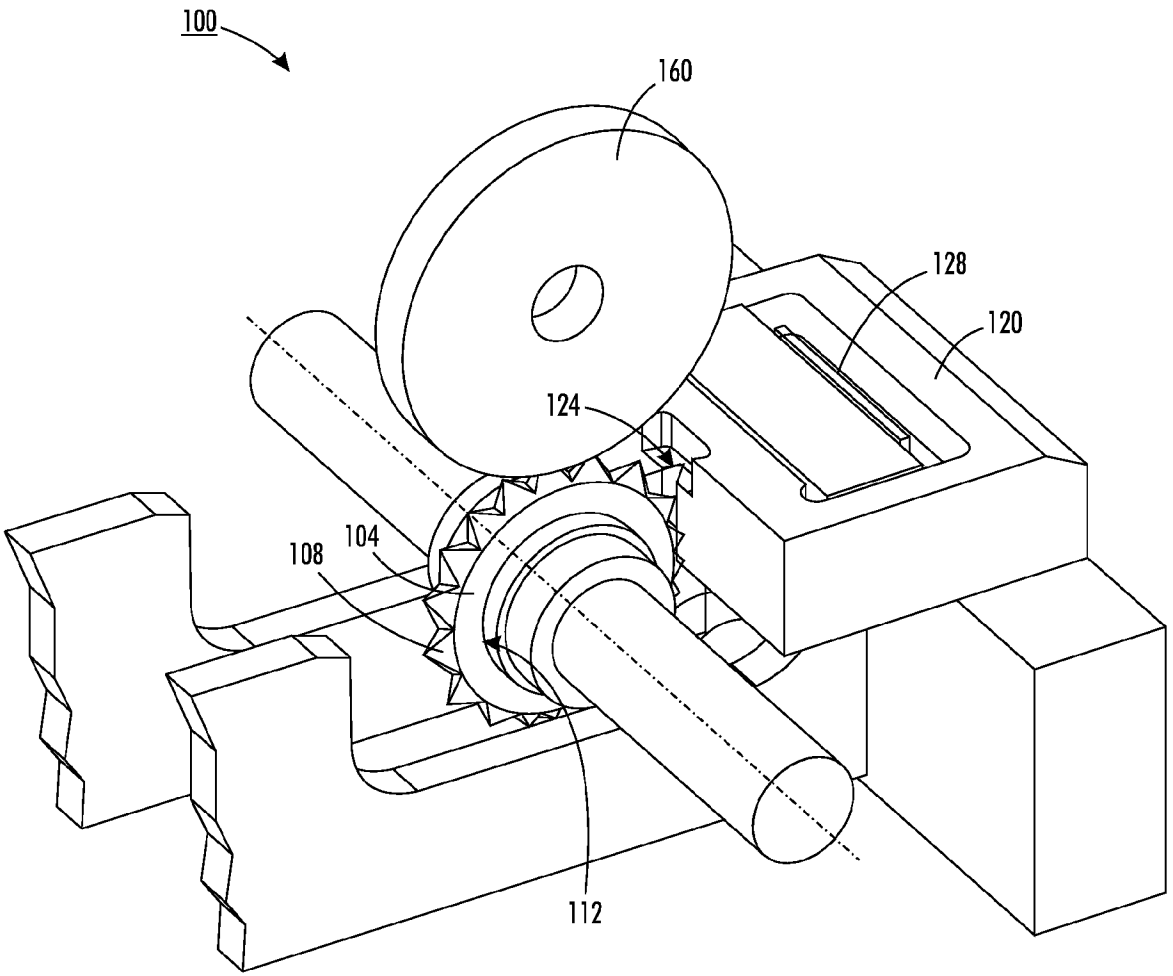
FIG. 4 is a perspective view of the media perforator of FIG. 1.

FIG. 2-4 depict the media perforator 100, which includes a perforation disk 104, a heated block 120, a collecting tray 140, and a backer roller 160. The perforation disk 104 has a plurality of teeth 108, which are positioned around a circumference of the disk 104 and are configured to engage the backer roller 160 to form a nip 164 through which the media web 14 is transported. The media web 14 moving in the process direction P through the nip 164 turns the perforation disk 104 in direction 180 and turns the backer roller 160 in direction 184. In other embodiments, one or both of the perforation disk and backer roller can be rotated by an actuator to facilitate the media web moving through the nip. As the media web 14 passes through the nip 164 between the perforation disk 104 and the backer roller 160, the teeth 108 of the rotating perforation disk 104 puncture the media web 14, forming a perforated line in the media web 14. In some embodiments, the perforation disk 104 and the teeth 108 of the disk 104 are coated with a hydrophobic substance, for example polytetrafluoroethylene (commonly referred to as "PTFE" and sold commercially as Teflon®), to enable phase change ink in a liquid state to flow off the perforation disk 104.

The heated block 120 includes a heating element 128 and an indentation 124. The heated block 120 is positioned to enable the indentation 124 to partially surround a portion of the perforation disk 104. The heating element 128 is operatively connected to a power source (not shown), and is configured to generate thermal heat as the power source selectively applies electric power to the heating element 128. The heating element 128 can be any suitable heater, for example, heat tape formed of multiple insulated nichrome wires braided into a strip. The heated block 120 is formed of a material having high thermal conductivity, for example, aluminum, to enable the heated block 120 to conduct the heat generated by the heating element to the indentation 124 and radiate the heat to the perforation disk 104. In some embodiments the heated block is coated with a hydrophobic substance, for example PTFE or silicone oil, to prevent ink from adhering to the heated block. In other embodiments, the heating block includes a thermally insulating layer over all surfaces except the indentation surfaces facing the heated block to reduce the amount of heat radiated by the block to other components in the printer.

As shown in FIG. 3, the indentation 124 has a shape similar to a cross section of the perforation disk teeth 108 to enable the heated block 120 to remain a predetermined distance from a first side 112 and a reverse side 116 of the perforation disk 104 to enable both sides 112 and 116 of the perforation disk 104 to be heated as the disk 104 rotates through the indentation 124. The indentation 124 is positioned substantially above the collecting tray 140 to enable ink that is melted and cast off the perforation disk 104 to land in the collecting tray 140.

In operation, the media web 14 is fed in the process direction P through the nip 164 formed between the teeth 108 of the perforation disk 104 and the backer roller 160, as shown in FIG. 2. As the web 14 moves through the nip 164, the teeth 108 of the perforation disk 104 penetrate the media web 14, forming a perforated line in the web 14. The motion of the web 14 also serves to turn the backer roller 160 in direction 184 and rotate the perforation disk 104 in direction 180. Alternatively, the perforation disk can be rotated by an actuator to facilitate the movement of the web through the nip.

As the media web 14 passes the perforation disk 104, some phase change ink on the media web, particularly ink on areas of the media web contacted by the perforation disk teeth 108, may break off the media web 14 and adhere to the sides 112 and 116 (FIG. 3) and between or on the teeth 108 of the perforation disk 104. As the perforation disk 104 continues to rotate in direction 180, the ink adhering to the disk 104 passes through the indentation 124 in the heated block 120. The heated block 120 radiates heat to the perforation disk 104 to increase the temperature of the disk 104 and any ink on the disk 104 above a predetermined temperature, which, in one embodiment is in a range of about 60° C. to about 95° C., to melt the phase change ink. The phase change ink is configured to have low viscosity at elevated temperatures to enable the ink to be ejected from the inkjets, and increasing the temperature of the ink on the perforation disk 104 to the predetermined temperature reduces the viscosity of the ink remaining on the disk 104, enabling the ink to flow from the disk 104. The combination of gravity and the centripetal force of the rotating disk 104 acting on the ink releases the liquid ink from the disk 104, and the ink drops into the collecting tray 140. The heated perforation disk 104 thus does not retain ink to deposit on the media web 14 in subsequent revolutions, preventing image defects resulting from unintended ink deposition by the perforation disk 104.

Figure 5:
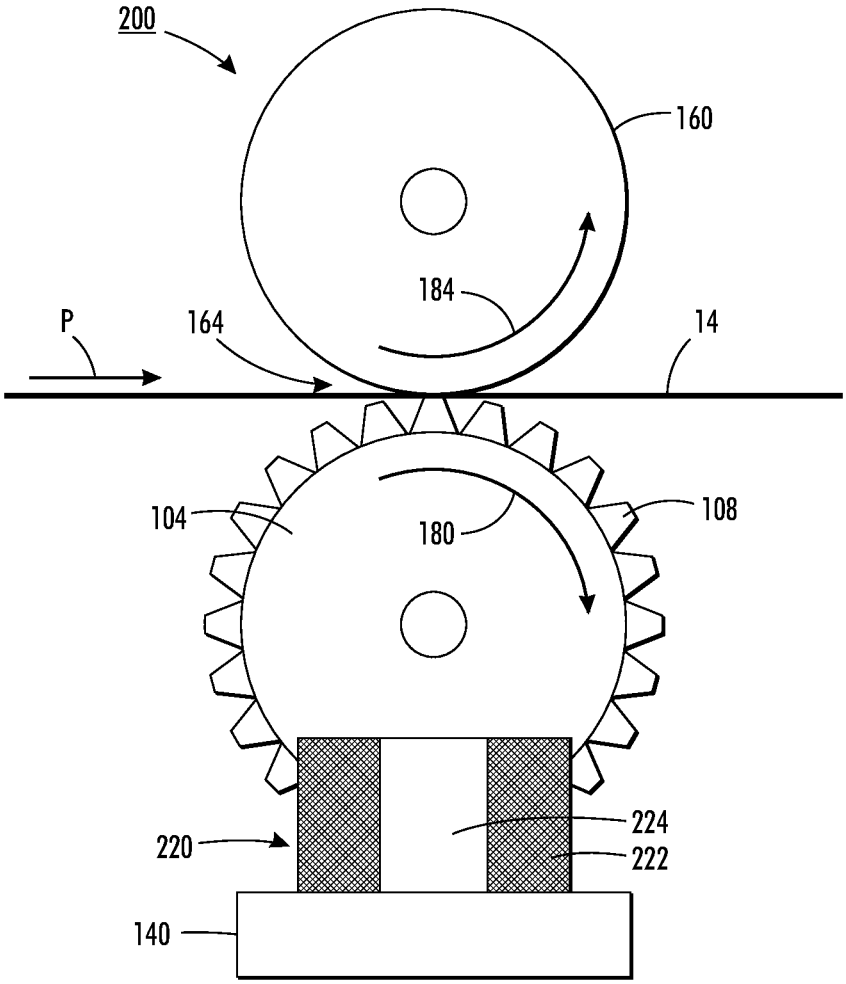
FIG. 5 is a side view of another media perforator.
Figure 6:
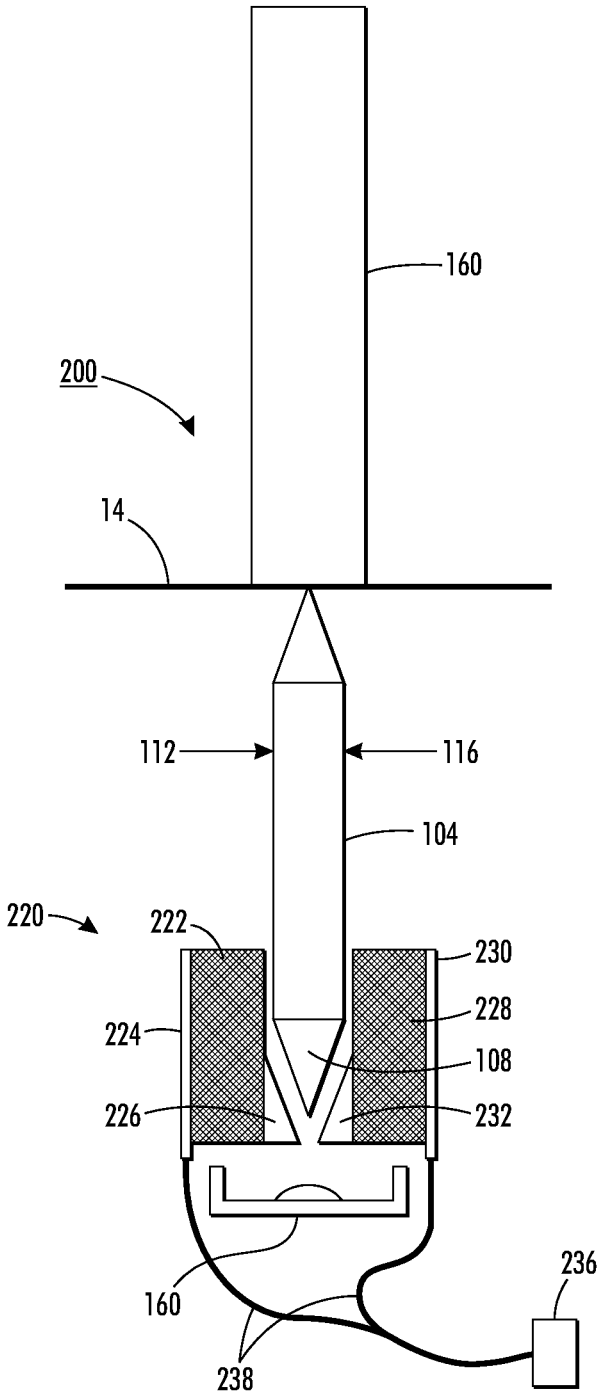
FIG. 6 is a front cross-sectional view of the media perforator of FIG. 5.

FIG. 5-6 depict another media perforator 200, which includes a perforation disk 104, a heater 220, a collecting tray 140, and a backer roller 160. The perforation disk 104, collecting tray 140, and backer roller 160 are arranged substantially identical to the perforation disk, collecting tray, and backer roller of the media perforator 100 of FIG. 1-4 to enable the perforation disk 104 to perforate the media web 14 as the web is fed through the nip 164 formed between the perforation disk 104 and the backer roller 160.

The heater 220 is positioned at the bottom of the perforation disk 104. The heater 220 includes a first heated plate 222 having a first heating element 224 and a first heater flange 226, a second heated plate 228 having a second heating element 230 and a second heater flange 232, and a power source 236. The first heated plate 222 is positioned proximate to the first side 112 of the perforation disk 104, while the second heated plate 228 is positioned proximate to the reverse side 116 of the perforation disk 104. The power source 236 is operatively connected to the first 224 and second 230 heating elements by electrical wires 238 to deliver electrical power to the heating elements 224 and 230. The power source 236 is configured to be selectively activated by, for example, the controller that operates the printheads and various other components in the printer, to retain the heated block at a predetermined temperature. Alternatively, heating elements can be used that provide a suitable amount of thermal heat to the heated plates at all times, and thus are always activated when the printer is on.

The first heating element 224 is mounted on a side of the first heated plate 222 opposite the perforation disk 104, while the second heating element 230 is positioned on a side of the second heated plate 228 opposite the disk 104. The heating elements 224 and 230 generate thermal heat to increase the temperature of the heated plates 222 and 228 to a predetermined temperature. The heated plates 222 and 228 are formed of a thermally conductive material to enable the plates 222 and 228 to conduct the heat generated by the heating elements 224 and 230 to the side of the plates 222 and 228 facing the perforation disk 104. The heated plates 222 and 228 are configured to radiate the thermal heat generated by the heating elements 224 and 230 to the first 112 and reverse 116 sides, respectively, of the perforation disk 104. The heated plates 222 and 228 include flanges 226 and 232, respectively, which are formed of thermally conductive material and are configured to extend from the plates 222 and 228 toward the teeth 108 of the perforation disk 104 to position the flanges 226 and 232 close enough to the teeth 108 to enable the flanges 226 and 232 to radiate heat to the teeth 108 of the perforation disk 104. The flanges 226 and 232 include an opening between each other to enable ink released from the perforation disk 104 to flow between the flanges 226 and 232 and drop into the collecting tray 160.

In operation, the perforation disk 104 is spun in direction 180 by the media web 14, piercing the media web 14 as the web 14 passes through the nip 164. Ink may transfer from the media web 14 and adhere to the sides 112 and 116 or teeth 108 of the perforation disk 104 as the perforation disk 104 perforates the media web 14. As the perforation disk 104 continues to rotate in direction 180, the ink adhering to the disk 104 passes between the heated plates 222 and 228, enabling the heated plates 222 and 228 to radiate heat to the disk 104 and any ink on the disk 104. The heat increases the temperature of the disk 104 to a predetermined temperature to melt the ink on the disk 104 and reduce the viscosity of the ink, enabling the ink to release from the perforation disk 104. The released ink flows into the space between the flanges 226 and 232 and drops into the collecting tray 160, ensuring that the perforation disk 104 is clean of ink and does not transfer ink to the media web 14 in subsequent revolutions.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a rotating disk having a plurality of teeth positioned around a circumference of the rotating disk, the teeth being configured to form perforations in a media web as the media web engages the rotating disk;

a roller configured to contact the teeth of the rotating disk to form a nip through which the media web is transported;

a heater configured to radiantly heat a portion of a first side of the rotating disk and a portion of a reverse side of the rotating disk to maintain the rotating disk within a predetermined temperature range that disables ink from adhering to the rotating disk as the rotating disk spins; and a tray positioned proximate to the rotating disk to receive phase change ink released by the rotating disk.

2. A printer comprising:

a rotating disk having a plurality of teeth positioned around a circumference of the rotating disk, the teeth being configured to form perforations in a media web as the media web engages the rotating disk;

a roller configured to contact the teeth of the rotating disk to form a nip through which the media web is transported; and a heater configured to radiantly heat a portion of a first side of the rotating disk and a portion of a reverse side of the rotating disk to maintain the rotating disk at a predetermined temperature that disables ink from adhering to the rotating disk as the rotating disk spins, the heater having a first heating element configured for selective connection to an electrical energy source and a first plate having high thermal conductivity, the first plate being operatively connected to the first heating element and positioned between the first heating element and the first side of the rotating disk to enable the first plate to radiate heat received from the first heating element to the rotating disk.

3. The printer of claim 2, the heater further comprising:

a second heating element configured for selective connection to an electrical energy source; and a second plate having high thermal conductivity operatively connected to the second heating element and positioned between the second heating element and the reverse side of the rotating disk to enable the second plate to radiate heat received from the second heating element to the rotating disk.

4. The printer of claim 3, the first and second heating elements substantially comprising heat tape.

5. A printer comprising:

a rotating disk having a plurality of teeth positioned around a circumference of the rotating disk, the teeth being configured to form perforations in a media web as the media web engages the rotating disk;

a roller configured to contact the teeth of the rotating disk to form a nip through which the media web is transported; and a heater configured to radiantly heat a portion of a first side of the rotating disk and a portion of a reverse side of the rotating disk to maintain the rotating disk at a predetermined temperature that disables ink from adhering to the rotating disk as the rotating disk spins, the heater having a block having high thermal conductivity, the block being configured to radiate heat towards the first side and the reverse side of the rotating disk and a heating element mounted on the block, the heating element being configured to heat the block to a temperature that enables the block to maintain the rotating disk at the predetermined temperature.

* * * * *